US006371861B1

(12) United States Patent
Ellingsberg

(10) Patent No.: US 6,371,861 B1
(45) **Date of Patent: *Apr. 16, 2002**

(54) BUMPER POCKET BILLIARD TABLE

(76) Inventor: Brett John Ellingsberg, P.O. Box 8, Santa Barbara, CA (US) 93120

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/273,664

(22) Filed: Mar. 23, 1999

(51) Int. Cl.[7] ..... A63D 15/00
(52) U.S. Cl. ..... 473/4
(58) Field of Search ..... 473/1, 2, 3, 18, 473/15

(56) References Cited

U.S. PATENT DOCUMENTS 3,700,235 A * 10/1972 Meyers et al. ..... 473/18
3,711,099 A * 1/1973 Milu ..... 273/123 R
4,819,937 A * 4/1989 Gordon ..... 473/417

* cited by examiner

*Primary Examiner*—Paul T. Sewell
*Assistant Examiner*—M. Chambers
(74) *Attorney, Agent, or Firm*—Donald J. Ellingsberg

(57) ABSTRACT

The Bumper Pocket Billiard Table in a preferred embodiment of the invention has a circular playing surface bounded by a circular cushion-and-rail assembly with a plurality of circular pocket openings positioned in the perimeter portion of the playing surface equidistant from adjacent pocket openings, and having at least one adjustable bumper post positioned on the playing surface adjacent to but spaced-apart by a selected dimension from the lip edge of an associated pocket opening, and with a selected constant dimension that is equivalent to the value of a predetermined width of a ball corridor or passageway so that the selected constant value is intended to complement the playing skill of a bumper pocket billiards player.

14 Claims, 5 Drawing Sheets

BUMPER POCKET BILLIARD TABLE

BACKGROUND OF THE INVENTION

1. Field of the Invention

A bumper pocket billiard table with one or more pockets, and with at least one adjustable bumper post positioned at a selected location relative to a pocket. In a preferred embodiment, the bumper pocket billiard table is circular with the bumper posts positioned only adjacent the pockets so that the table can be used for the play of BumperGolf™ Billiards.

2. Description of the Related Art

Rectangular pocket billiard tables as endorsed by the Billiard Congress of America (BCA) are considered to be conventional and, therefore, well known in the field of billiards. Bumper pool tables, which are generally smaller in size than regulation pocket billiard tables, are usually hexagonal or octagonal in shape with one or more pockets and a pattern of bumper posts usually positioned at table center. Bumper pool tables, like some pocket billiard tables, can be multi functional so that different orientations of or additions to the table permit it to be converted for other uses. For example, converted to a dining table, a game table for card or dice games, or the bumper pool playing surface. These bumper pool tables are sometimes identified as a "3-in-1" game table. Such bumper pool tables are also considered to be conventional and well known.

Throughout the years there have been variations to rectangular pocket billiard tables. There have also been variations to bumper pool tables. Selected references that individually teach one or more of these variations are as follows:

1. A circular or round pool game tabletop is taught by U.S. Pat. No. 217,370 where the tabletop has six pockets with each pocket positioned at 60° or a multiple thereof and equidistant from adjacent pockets.
2. A circular billiard and pool table having one central pocket is taught by U.S. Pat. No. 296,677.
3. A circular parlor pool table is taught by U.S. Pat. No. 606,546 having four pockets with each pocket positioned at 90° or a multiple thereof and equidistant from adjacent pockets.
4. An octagonal golf court table is taught by U.S. Pat. No. 1,625,265 having each one of eight pockets positioned at the vertices developed by the billiard type cushion sides.
5. A circular playing table for marbles is taught by U.S. Pat. No. 2,219,675 having four pockets with each pocket positioned at 90° or a multiple thereof and equidistant from adjacent pockets where each pocket has a vertical wall surface that opens into the table playing surface.
6. An oval or elliptical billiard table is taught by U.S. Pat. No. 3,463,489 having separate playing areas each with a focal point and either two-, three-, or four-pockets positioned at each respective focal point where each pocket has a vertical wall surface that opens into the particular playing area.
7. An hour-glass pool table with linear cushion rails is taught by U.S. Pat. No. 3,544,108 having six pockets with a separate bumper post spaced-apart from the lip opening of each of two pockets "located at the apices of the rail projections" which define the necked portion of the hour-glass table.
8. A circular billiard table is taught by U.S. Pat. No. 3,700,235 having six pockets with each pocket positioned at 60° or a multiple thereof and equidistant from adjacent pockets spaced a uniform distance apart, where each rail cushion therebetween has an intermediate bumper formed on the rail to prevent a cue or object ball from riding the rail until it drops into a pocket.
9. An octagonal 3-in-1 convertible bumper pool table is taught by U.S. Pat. No. 3,711,099 having a playing surface with two opposing pockets. Each circular pocket has a vertical wall that transitions to the playing/support surface through a radius that would appear equivalent to a BCA drop point slate radius of about ¼ inch. Each pocket is flanked by a spaced-apart pair of conventional bumper posts positioned on the playing/support surface and apart from the adjoining resilient cushion. A cross-shaped configuration of similar obstacle bumper posts is arranged in a generally centralized region of the playing surface. The bumper pool table of Pat. No. 3,711,099 is considered to be conventional and representative of today's popular bumper pool tables. (See also ESCALADE Sports of Evansville, Ind. that market a comparable 3-in-1 convertible bumper pool table having a removable dining table top which functions as a poker table when the top is turned over, and exposes a conventional bumper pool table when the top is removed. CAMELOT Billiards at http://www.calspas.com offers a similar 3-in-1 game table.)
10. A pentagonal and rotatable pool table is taught by U.S. Pat. No. 3,801,097 having five pockets.
11. A circular pool table that provides for the selection of a pocket opening in the periphery of a playing surface is taught by U.S. Pat. No. 4,147,345 where several adjacent cushion segments are tipped away from the playing surface to create a pocket opening to a circular gully on the table rim. The gully wall is vertical to support a "rim like" playing surface with no apparent BCA "drop point slate radius" at the junction of the gully wall and playing surface. (See also a similar circular pool/game table taught by U.S. Pat. No. 5,135,218.)
12. A cruciform game table is taught by U.S. Pat. No. 5,026,052 having four oval pockets spaced equally around a central circular playing area with each generally rectangular playing area that form a respective base area in each arm of the cruciform.
13. A hexagonal pocket billiard pool table having six pockets with each pocket positioned at 60° or a multiple thereof and equidistant from adjacent pockets is available in today's market. This pool table has the hexagonal playing surface mounted on a "lazy-susan" system so that the table can be located in a corner of a room. The playing surface is rotated (compare with Pat. No. 3,801,097 as described above) to where a player is standing during play so that the player does not have to physically move around the table (see http://www.flash.net~jsa/pool/round.html).

Each of the foregoing variations to pocket billiard tables and to bumper pool tables, while contributing to the advancement of pocket billiard tables and bumper pool tables, do not provide an adequate bumper pocket billiard table for the play of BumperGolf™ Billiards.

SUMMARY OF THE INVENTION

Briefly, in accordance with the invention, one embodiment of a new and improved bumper pocket billiard table is provided having a circular playing surface bounded by a circular cushion-and-rail assembly with four circular pocket openings positioned in the perimeter portion of the playing surface and at least one bumper post, which can be adjustable, positioned on the playing surface at one of several bumper post sites adjacent to but spaced apart from the lip edge of a pocket opening at a selected dimension, and with a sell constant dimension that is equivalent to the value of a predetermined ball corridor or passageway width in order to complement the playing skill of a bumper pocket billiards player such as one playing BumperGolf™ Billiards.

OBJECTS OF THE INVENTION

Accordingly, it is an object of the invention to provide a new and improved Bumper Pocket Billiard Table.

Another object is to provide a Bumper Pocket Billiard Table that is suited for the play of BumperGolf™ Billiards.

Another object is to provide a Bumper Pocket Billiard Table that is circular with one or more pockets located in the circular playing surface bounded by a circular cushion and rail.

Another object is to provide a Bumper Pocket Billiard Table that is circular with one or more pockets located in the circular playing surface bounded by a circular cushion and rail, and with at least one bumper post positioned adjacent to a pocket opening for more challenging play.

Another object is to provide a Bumper Pocket Billiard Table that has a circular playing surface where the pockets are preferably circular or round but can also be oval in geometry.

Another object is to provide a Bumper Pocket Billiard Table with at least one bumper post that is adjustable to at least one bumper post site adjacent to a pocket opening; again, for more challenging play.

Another object is to provide a Bumper Pocket Billiard Table with at least one bumper post that is adjustable without affecting a selected ball corridor or passageway for more challenging play whether as an amateur or professional billiards player.

Another object is to provide a Bumper Pocket Billiard Table with at least one bumper post that is adjustable without affecting a selected ball corridor or passageway along a circular cushion so that a ball in play can "ride-the-rail" into a pocket without interference from such bumper post.

Another object is to provide a Bumper Pocket Billiard Table having no obstructions such as one or more bumper posts positioned at or near the center of the playing surface.

Another object is to provide a Bumper Pocket Billiard Table that is circular with a circular cushion and rail that requires a minimum of space for set up of the Table.

Another object is to provide a Bumper Pocket Billiard Table that has an assembled circular top with circular playing surface bounded by a circular cushion and rail where the assembled top is rotatable on a suitable support base for the Table.

Another object is to provide a Bumper Pocket Billiard Table for the play of BumperGolf™ Billiards that has the "feel" of putting on a golf green in the play of regulation golf.

Another object is to provide a Bumper Pocket Billiard Table that is oval with one or more pockets located in the oval playing surface bounded by an oval cushion and rail, and with at least one bumper post positioned adjacent to each pocket opening.

Another object is to provide a Bumper Pocket Billiard Table that can be readily manufactured from relatively low cost manmade materials if desired.

Further objects, features, and the attending advantages of the present invention, particularly in view of the technology to which the invention relates, will be apparent to a person having ordinary skill in this art when the following description of the invention is read and understood alone with the drawings.

DESCRIPTION OF THE PREFERRED EMBODIMENT

Figure 1:
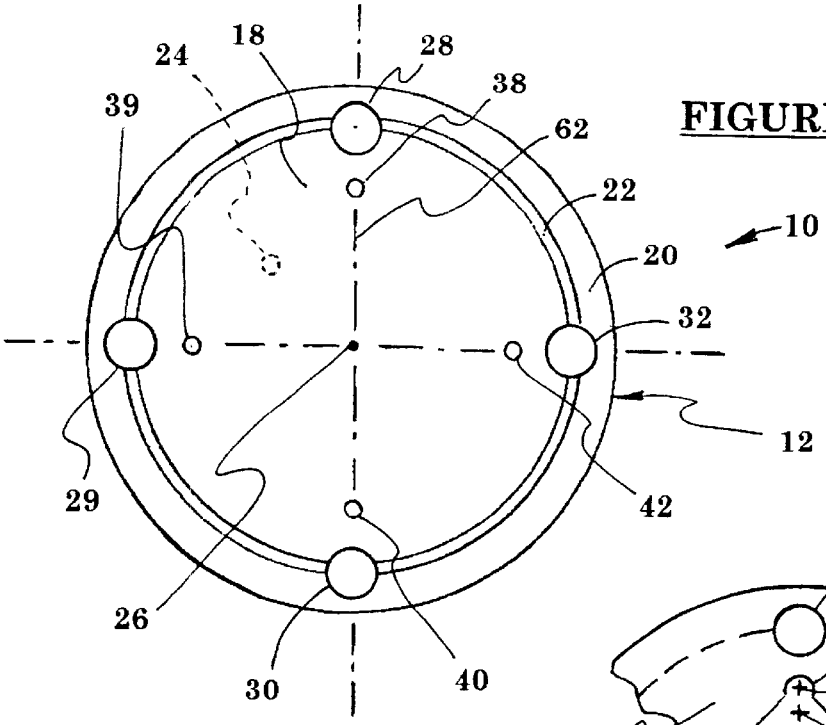
FIG. 1 is plan view, not to scale, of the obverse or playing surface of a preferred embodiment of the Bumper Pocket Billiard Table as the present invention herein described.
Figure 2:
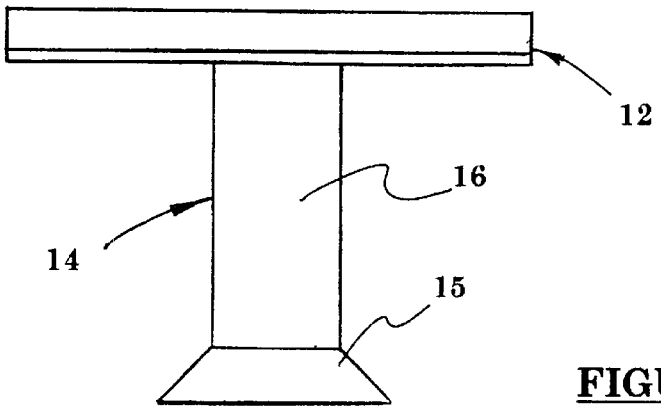
FIG. 2 is a schematic elevation view, not to scale, of the Bumper Pocket Billiard Table of FIG. 1.

A preferred embodiment of the Bumper Pocket Billiard Table 10 of the present invention is shown by FIG. 1. The Bumper Pocket Billiard Table 10 (hereinafter sometimes referred to as "BPB") has an assembled tabletop 12 and a pedestal assembly 14 as shown by FIG. 2. The pedestal assembly 14 can have a footed portion 15 and a vertical pillar portion 16, and can be connected to the tabletop 12 with suitable fasteners which permit easy separation of the tabletop from the pedestal assembly for ease of storage or transport, or the like. Where there is limited space for the BPB Table 10 that could prevent normal play of bumper pocket billiards, it is contemplated that the tabletop 12 could be connected to the pedestal assembly 14 by conventional lazy-susan hardware fittings. The assembled tabletop can also be supported by a variety of different table legs (not shown but considered to be conventional and available through any of several catalogs).

An obverse bed plane or playing surface 18 of the assembled tabletop 12, as shown by FIG. 1, is circular or round for the preferred embodiment BPB Table 10 of the invention. The playing surface 18 can be formed from conventional slate, or can be formed from a manmade material such as a composite ceramic, plastic, or the like. The playing surface is preferably covered with a conventional 22-ounce billiard cloth or fabric, such as a wool-based felt, of a selected color. The circular, rigid tabletop assembly 12 has a circular 360° rail 20 that can be formed from a material such as a hardwood or a rigid synthetic material. A complementary cushion 22, which can be formed from a conventional resilient material such as rubber, is also covered with the conventional billiard cloth or felt used for covering the playing surface 18. The circular top rail 20 is preferably not covered. The assembled cushion 22 and top rail 20 define and form an outer edge or perimeter of the bed or playing surface 18. The cushion 22 extends inwardly over the peripheral edge of the common plane defined by the bed or playing surface 18 toward a center point 26 of the Table. A center spot 26, which can be a conventional piece of cloth or paper with screen-printed spot, is glued onto the billiard fabric that covers the playing surface 18. This center spot 26 marks the exact center point of the circular playing surface of the BPB Table 10. During play of a game on BPB Table 10, a ball rebounds from circular rail cushion 22 with a rebound angle that can be substantially different when compared to the angle of incidence-angle of reflection (rebound), which is exhibited by the straight rail cushion of a BCA regulation pocket billiard table. Such a ball, for purposes of this description, can be a regulation BCA billiard ball 24 as shown in phantom by FIG. 1. In accordance with BCA regulations, a BCA billiard ball should be a perfect sphere 2.25 inches in diameter, and be no more than 6 ounces in weight. Like play of regulation pocket billiards, regulation BCA balls can be used in the play of BumperGolf Billiards.

The Bumper Pocket Billiard Table 10 of FIG. 1 has four identical pockets 28, 29, 30 and 32 positioned around the circular top 12 equidistant from adjacent pockets at 90°, 180°, 270° and 360° (0°). Each pocket is preferably a round pocket opening in the perimeter region of the playing surface 18 and assembled tabletop. In accordance with BCA regulations, a pocket opening called "mouth" is measured from tip-to-tip of the opposing cushion noses. Each cushion nose is called a "jaw"(see jaws 34 and 36 in FIG. 4). The mouth opening is where the direction of the cushion edge or nose 60 changes into the pocket (see FIG. 4). Each pocket opening, such as pocket 28, is partially bounded by the adjoining portion of the assembled rail 20 and cushion 22 of BPB Table 10. The pockets, i.e., 28, 29, 30, and 32, can be either drop pockets or gully pockets although a drop pocket is shown by FIG. 5 for the preferred embodiment of BPB Table 10.

Figure 5:
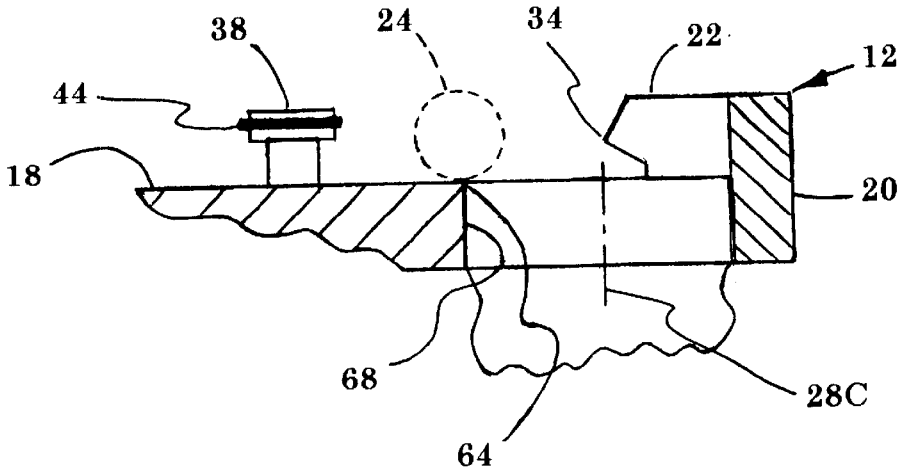
FIG. 5 is a schematic cross section of the portion of the obverse or playing surface, partly broken away, of FIG. 4 along the line 5—5 during play of BumperGolf™ Billiards.
Figure 6:
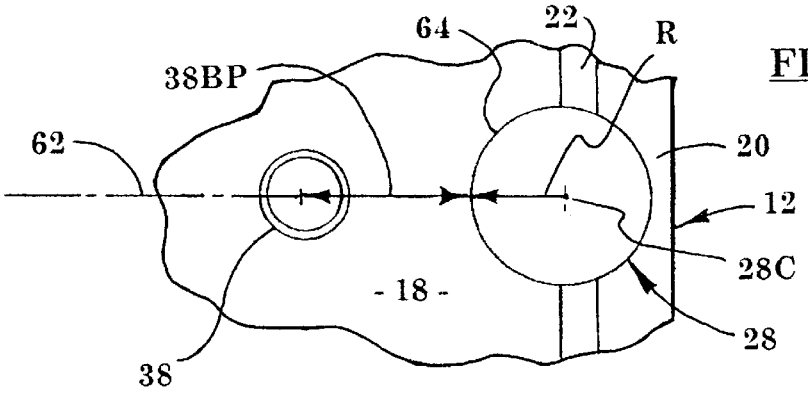
FIG. 6 is another plan view, partly broken away, of the portion of the obverse or playing surface of the Bumper Pocket Billiard Table of FIG. 1 as also shown by FIG. 4.
Figure 7:
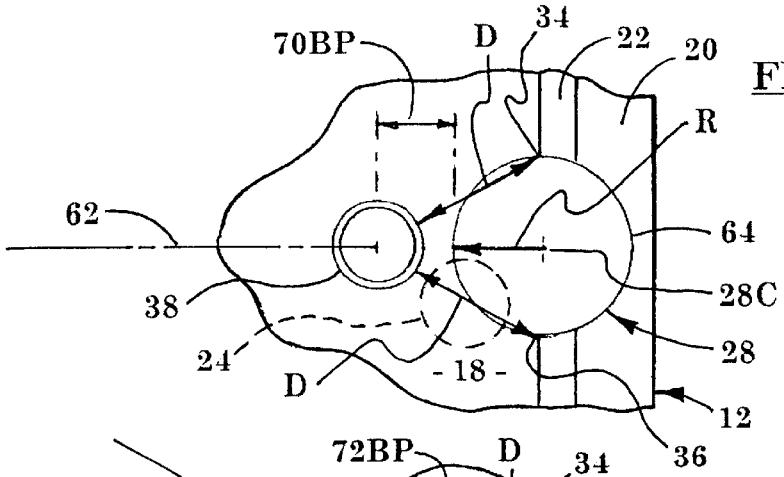
FIG. 7 is a plan view, partly broken away, of the obverse or playing surface of another Bumper Pocket Billiard Table in accordance with the present invention.

Referring now to FIG. 1, and to FIGS. 6 and 7, identical bumper posts 38, 39, 40 and 42 are positioned on and fastened to the playing surface 18 adjacent to and spaced apart from an associated pocket openings 28, 29, 30 and 32. The bumper posts can be selected from any one of several standard bumper pool posts that are commercially available. For example, one standard bumper pool post is about 1.75 inches high and 2.125 inches in diameter. This bumper post diameter includes a resilient impact ring 44 retained on the bumper portion of the post (see FIGS. 4 and 5).

Figure 3:
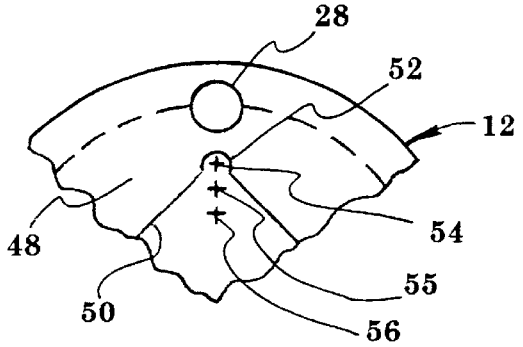
FIG. 3 is a schematic plan view, partly broken away, of a portion of the reverse surface of the Bumper Pocket Billiard Table of FIG. 1.

The reverse surface 48 of the assembled tabletop 12 of FIG. 1 is shown by FIG. 3. The reverse surface can have a suitable recess 50 formed therein that is adapted and dimensionally configured to locate and retain the pillar portion 16 of pedestal 14 of FIG. 2. However, it is contemplated that a recess such as recess 50 would not always be necessary or required to fasten the support pedestal, or other suitable table legs, to the tabletop 12.

In the preferred embodiment of the Bumper Pocket Billiard BPB Table 10 as shown by FIG. 3, the recess 50 has a niche projection, similar to niche projection 52, formed at each of the corresponding 0°, 90°, 180° and 270° pocket locations. In FIG. 3, niche projection 52 is associated with pocket 28 at 90°. These similar niche projections, like projection 52, correspond and complement a selected position site for locating and fastening each of the bumper posts 38, 39, 40 and 42. The fastener portion of each bumper post (not shown) is considered to be a conventional fastener assembly such as a threaded bolt adapted to receive a complementary nut and washer. This fastener portion is inserted into the obverse or playing surface 18 (see FIG. 1) at its corresponding and selected bumper post site, such as site 56 within niche projection 52 as shown by FIG. 3. A bumper post site, such as site 56, receives the fastener portion of the bumper post 38. Bumper post site 56 can be either a clear hole through the tabletop or a blind hole in the playing surface 18 of the tabletop.

It is contemplated that other bumper post sites, such as post sites 54 and 55 as shown by FIG. 3, could be provided in a similar manner adjacent to and spaced apart from an associated pocket opening. These alternate bumper post sites permit positioning a bumper post at different distances from a selected pocket opening for the playing of certain bumper pocket billiard games, or also for different levels of playing skills by game participant(s), or the like. It is also contemplated that a niche projection, such as niche projection 52, would not be required where no recess is necessary. It is further contemplated that a hole, such as the described clear hole, could be threaded or have a threaded metal insert positioned therein; both to receive and retain the complementary threaded bolt portion of a bumper post, such as bumper post 38.

Figure 4:
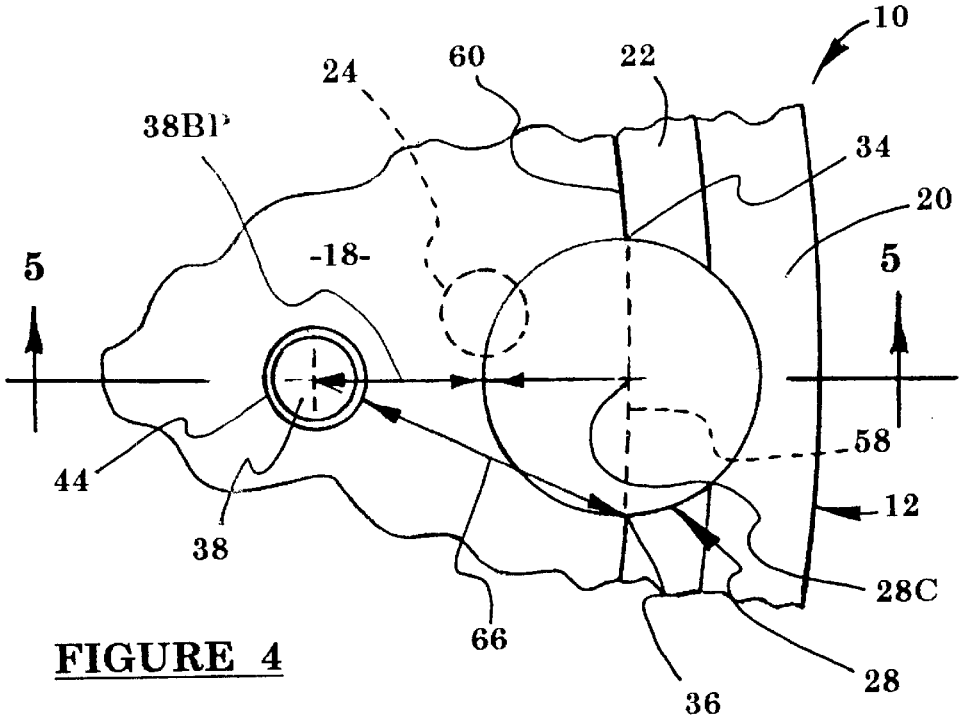
FIG. 4 is an enlarged and partly broken away plan view, not to scale, of a portion of the obverse or playing surface of the Bumper Pocket Billiard Table of FIG. 1.

Referring now to FIG. 4, a portion of the playing surface 18 of the Bumper Pocket Billiard Table 10 is shown with pocket 28 at the 900 position. As described above, pocket 28 opens into the playing surface 18 in the perimeter of the tabletop, and opens as well into the top rail 20 and cushion 22 of tabletop assembly 12. Opposite jaws 34 and 36 define the mouth of the pocket. Dashed line 58, which represents an imaginary extension of the nose or impact edge 60 of the cushion 22, passes through the center 28C of the circular pocket opening 28. Dashed line 58, for ease of description here, is considered to be equivalent to the diameter of the pocket opening. The actual measurement, however, obviously is a fraction of an inch longer than the diameter length because dashed line 58 describes an arc rather than a straight line.

Therefore in the BPB Table 10 of the invention as shown by FIGS. 4 and 6 (schematically by FIG. 6), the pocket opening 28 has a diameter of about 4.75 inches between the jaws 34 and 36. In FIG. 6, an imaginary line 62 originates at pocket opening center 28C of pocket opening 28, and extends generally perpendicular to line 58 along radius R and to table center 26, which is particularly shown by FIG. 1. Bumper post 38 is located or positioned on this imaginary line 62 at bumper post site 56 (see FIG. 3). (It is important to note for purposes of the description hereinafter concerning radius R, that the dimension of R in each instance will have the following constants. Representative pocket opening 28 has a diameter of 4.75 inches, and radius R has a corresponding length of 2.38 inches as rounded to two decimal points.)

The measured distance between the bumper post site 56 and the adjacent lip edge 64 of pocket opening 28, as represented by double-arrowhead line 38BP, has a length of about 4.00 inches. Because the diameter of the bumper post 38 used herein for purpose of description is about 2.13 inches, the resilient ring 44 on bumper post 38 has a ball impact point about 2.93 inches from the adjacent lip edge 64 of pocket opening 28. Similarly, the impact point of resilient ring 44 is about 5.75 inches from jaw 36 of the adjacent cushion 22 as represented by double-arrowhead line 66. The standard BCA billiard ball 24, with a diameter of 2.25 inches as shown by FIG. 1, is again shown here in phantom on the playing surface 18 of the BPB Table 10. The ball 24 is shown by FIG. 4, and particularly by FIG. 5, positioned substantially on the lip edge or rim 64 of pocket opening 28. (Note that herein, all of the values given in inches or any fraction thereof are rounded to two decimal points.)

One of the advantages of the Bumper Pocket Billiard Table 10 is best understood by continuing to refer to FIG. 5. Each pocket opening, such as pocket opening 28 as shown, has a substantially right-angle lip edge 64 where the vertical wall 68, which defines pocket opening 28, opens into the playing surface 18. The advantage of this lip edge configuration for the pocket opening in the BPB Table 10 of the invention is evident during play of BumperGolf™ Billiards in accordance with standard BumperGolf™ instructions. (These BumperGolf™ instructions are the subject of separate copyright protection.) The ball 24, as shown in phantom by FIG. 5, can literally "hang" on the hp edge 64 of the pocket opening 28 during the play of BumperGolf™ Billiards. This is similar to the play of a conventional game of golf on a golf course where it is well known that a standard golf ball can "hang" on the lip of a green cup rather than drop in. Similarly like a golf ball, a BumperGolf™ ball 24 can roll and "rim" the lip edge or rim 64 without actually dropping into pocket opening 28. All of these golf-like happenings tend to heighten the already inherent excitement that is experienced during the play of BumperGolf™ Billiards!

Figure 8:
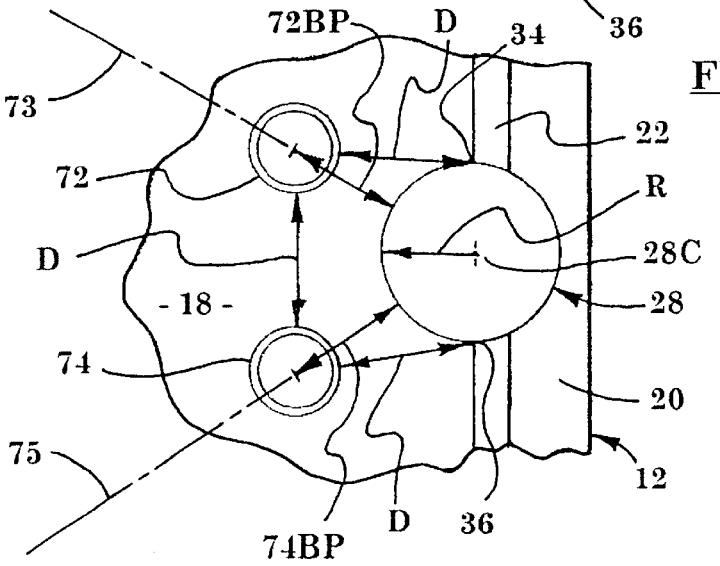
FIG. 8 is a plan view, partly broken away, of the obverse or playing surface of another Bumper Pocket Billiard Table in accordance with the present invention.
Figure 9:
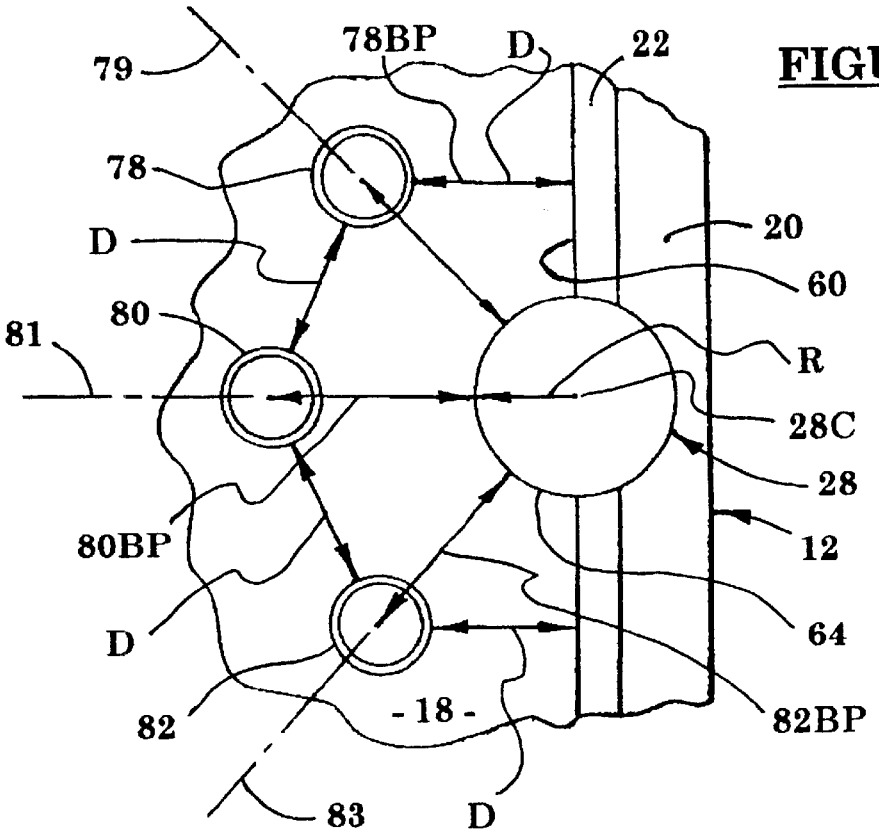
FIG. 9 is a plan view, partly broken away, of the obverse or playing surface of another Bumper Pocket Billiard Table in accordance with the present invention.

The above description of pocket opening 28 in view of FIGS. 4 and 6 facilitates a better understanding of the following description for FIGS. 7, 8 and 9 which schematically show other contemplated configurations of playing surface 18 for the Bumper Pocket Billiard Table 10 of the invention.

In FIG. 7, another form of playing surface 18 configuration for the Bumper Pocket Billiard Table 10 of the invention is illustrated. In this playing surface configuration of FIG. 7, the bumper post 38 as has been described in view of FIGS. 4 and 6 is positioned at post site 54 (see FIG. 3) on imaginary line 62 and adjacent to lip edge 64 of representative pocket opening 28. The impact point of bumper post 38 is located 1.22 inches from the lip edge 64 as represented by double arrowhead 70BP. The post site 54 for bumper post 38 provides a professional layout of playing surface 18 for the play of BumperGolf™ Billiards.

In FIGS. 7 through 9, a ball corridor (considered to be a passageway for any ball in play) is developed between a designated bumper post and its nearest adjacent point on the nose edge of a rail cushion. The width of the ball corridor is identified by a double-arrowhead D in FIGS. 7 through 9. The width of this ball corridor D can be selected to measure about 3.25 inches. This linear value of 3.25 inches is selected as a desired ball corridor width and corresponds with a known level of skill in the play of BumperGolf™ Billiards. The linear value for the width of ball corridor D can be determined as follows: add the diameter of a regulation BCA billiard ball, 2.25 inches, to a selected value of 0.50 inch for an adjoining space on either side of the ball which results in a total of 3.25 inches. It is contemplated that the dimension of ball corridor D can be greater, or even smaller, than this total of 3.25 inches. The variable dimension as the width of ball corridor D depends on the level of skill of those who are playing BumperGolf™ Billiards. It is contemplated that the width of the ball corridor D could be less than the above stated dimension of 3.25 inches as shown by FIGS. 1 through 9. However, it is obvious that D could not be less than the diameter of a particular ball, such as representative ball 24, which is used in play! Therefore, the width of a ball corridor D can have a predetermined range of values. For example, one range of width values for D has a lower or minimum value of slightly more than 2.25 inches and an upper or maximum value of about 5.75 inches. This range of values is preferred for the play of BumperGolf™ Billiards on the BPB Table 10 of the invention since a particular value for D can be selected to match the playing skill of those playing.

However, it is contemplated that the preferred range described above could have an upper value that is greater for unskilled players. The BPB Table 10 as shown by FIGS. 1 through 6 can be considered a BPB Table configured with a playing surface 18 that is suitable for unskilled players. Double-arrowhead 66, which here is the equivalent to the width of ball corridor D as described above, has a dimension of about 6.40 inches. This is an upper value that is outside the range of values from 2.25+-to-5.75 inches for the width of ball corridor D.

In each form of playing surface 18 configuration as described herein, particularly as such description is in view of FIGS. 7 through 9, the width of ball corridor dimension D will be the selected value of 3.25 inches which will be considered a constant value.

In FIG. 8, another form of playing surface 18 configuration for the Bumper Pocket Billiard Table 10 of the invention is illustrated. In this playing surface configuration of FIG. 8, a pair of bumper posts 72 and 74 (similar to bumper post 38 as described and shown in particular by FIG. 4) are each positioned at a provided post site. Bumper post 72 is positioned on an imaginary line 73 that extends from the center 28C of representative pocket opening 28. The bumper post 72 is located about 3.12 inches from the adjacent lip edge 64 as represented by double-arrowhead 73BP. Bumper post 74 is positioned on an imaginary line 75 that extends from the center 28C of representative pocket opening 28. The bumper post 74 is also located about 3.12 inches from the adjacent lip edge 64 as represented by double-arrowhead 74BP. A separate ball corridor (passageway for a ball in play as has been described above) is developed between bumper posts 72 and 74, and the nearest adjacent jaw 34 and 36, respectively, of pocket opening 28. Each identical ball corridor is identified by identical double arrowhead D, which as described above represents the width of each ball corridor and has a value of 3.25 inches.

In FIG. 9, another form of playing surface 18 configuration for the Bumper Pocket Billiard Table 10 of the invention is illustrated. In this playing surface configuration of FIG. 9, three bumper posts 78,80 and 82 (similar to bumper post 38 as described and shown in particular by FIG. 4) are each positioned at a selected bumper post site. Bumper post 78 is positioned on an imaginary line 79 that extends from the center 28C of representative pocket opening 28. The bumper post 78 is located about 4.50 inches from the adjacent lip edge 64 as represented by double-arrowhead 78BP. Bumper post 80 is positioned on an imaginary line 81 that extends from the center 28C of representative pocket opening 28 to table center 26. The second bumper post 80 is located about 4.00 inches from the adjacent lip edge 64 as represented by double-arrowhead 81BP. The third bumper post 82, which is similar to bumper post 78, is located about 4.50 inches from the adjacent lip edge 64 as represented by double-arrowhead 83BP. A ball corridor (again, the width of the passageway for a ball in play) developed between the pair of bumper posts 78 and 80, and between the pair of bumper posts 80 and 82 is identified in each instance by double-arrowhead D. Similar ball corridors are developed between bumper post 78 and its nearest point on the nose edge 60 of cushion 22, and also between bumper post 82 and its nearest point on the nose edge 60 of cushion 22; these are also identified by the double-arrowhead D. The width of ball corridor D between bumper posts 78 and 82 and the respective nearest impact point on cushion 22 permits a BPB player to propel an object ball, such as ball 24, through the ball corridor. In certain play situations, the object ball rolls along and "hugs" the cushion edge 60 as it travels to a desired pocket opening. This aspect in the play of pocket billiards is sometimes known as to "ride-the-rail". As described above, the width of ball corridor D in each instance has a selected constant value of 3.25 inches.

Figure 10:
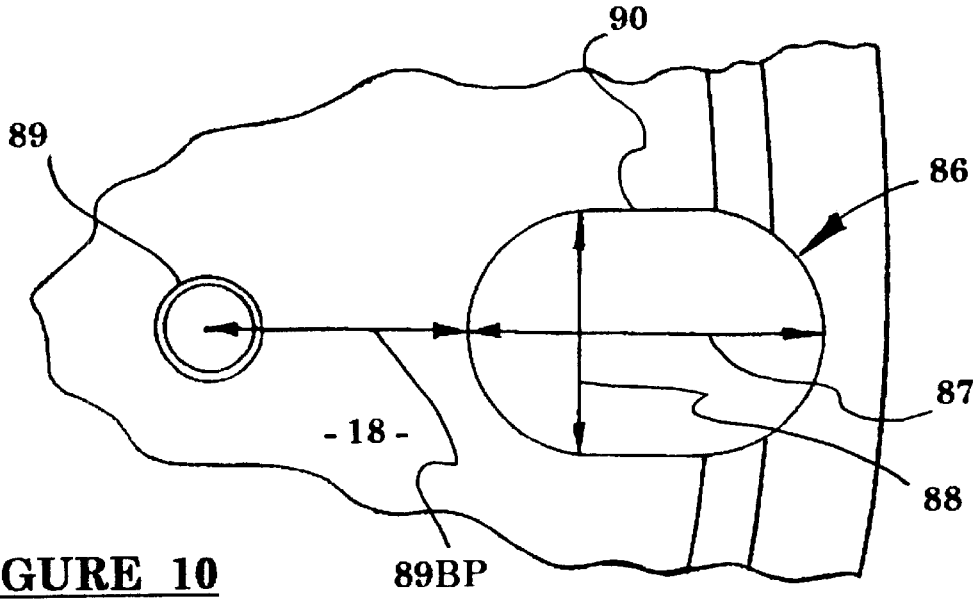
FIG. 10 is a partly broken away plan view, not to scale, of the obverse or playing surface of another pocket configuration for the Bumper Pocket Billiard Table in accordance with the present invention.

The preferred embodiments of the Bumper Pocket Billiard Table 10, as described and shown by FIGS. 1 through 9, have circular pocket openings, such as representative pocket opening 28. It is contemplated that such a pocket opening can be other than circular. In FIG. 10, another embodiment of a Bumper Pocket Billiard Table in accordance with the invention has a generally oval pocket opening 86 where the oval has a major axis 87 and a minor axis 88 perpendicular thereto. In one embodiment of a BPB table, the major axis has a dimension of 5.75 inches and a minor axis dimension of 4.75 inches. An associated bumper post 89 is positioned on an imaginary extension (not shown) of major axis 87, and located at a bumper post site about 4.00 inches from a lip edge 90 of the pocket opening 86, as represented by double-arrowhead 89BP.

Figure 11:
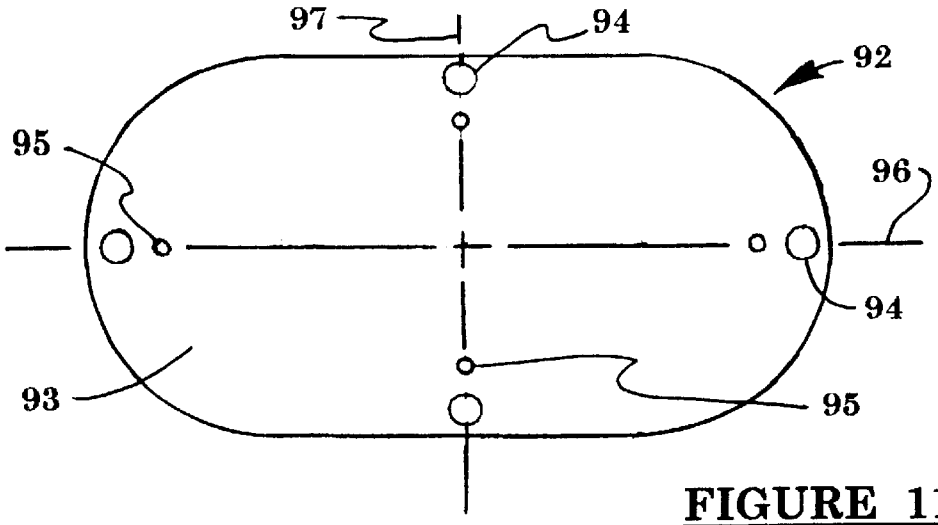
FIG. 11 is a schematic plan diagram of another Bumper Pocket Billiard Table in accordance with the present invention.

Referring to FIG. 11, another embodiment of Bumper Pocket Billiard Table 92 has an oval playing surface 93 with four similar pockets 94, which can be either circular or oval, and four similar bumper posts 95. Each of he pockets 94 and bumper posts 95 can have a structural relationship as to location and dimensions that are in accord with the particular description of a Bumper Pocket Billiards Table as shown by the FIGS. 1 through 10. One pair of similar pockets 94 are positioned on a major axis 96 of BPB Table 92, and the remaining pair of similar pockets 94 are positioned on a minor axis 97. Minor axis 97 is oriented generally perpendicular to major axis 96, and generally at an approximate midpoint of the major axis as shown.

Figure 12:
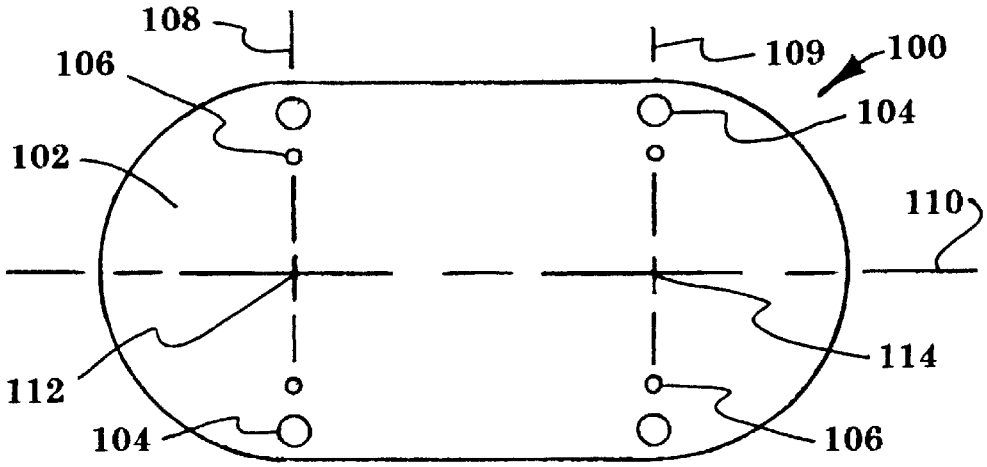
FIG. 12 is a schematic plan diagram of yet another Bumper Pocket Billiard Table in accordance with the present invention.

Referring to FIG. 12, another embodiment of Bumper Pocket Billiard Table 100 has an oval playing surface 102 with four similar pockets 104 and four similar bumper posts 106. Each of the pockets 104 and bumper posts 106 can have a structural relationship as to location and dimensions that are in accord with the particular description of a Bumper Pocket Billiards Table as shown by the FIGS. 1 through 10. A first pair of similar pockets 104 are positioned on a minor axis 108 of BPB Table 100, and the remaining pair of similar pockets 104 are positioned on a second minor axis 109 as shown by FIG. 12. Both minor axes 108 and 109 are oriented perpendicular to a major axis 110. Minor axis 108 passes through a first focus 112, and minor axis 109 passes through a second focus 114.

Figure 13:
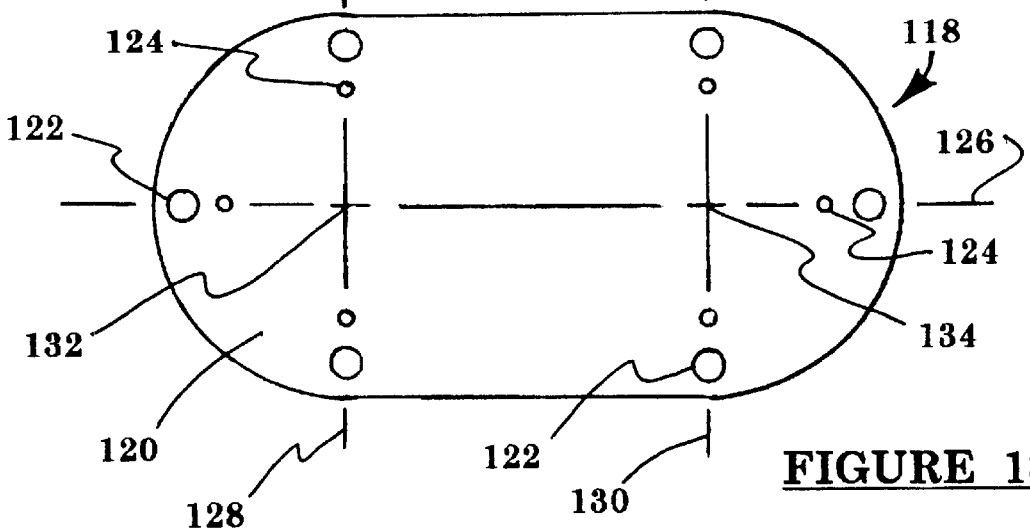
FIG. 13 is a schematic plan diagram of yet another Bumper Pocket Billiard Table in accordance with the present invention.

Referring to FIG. 13, another embodiment of Bumper Pocket Billiard Table 118 has an oval playing surface 120 with six similar pockets 122 and six similar bumper posts 124. Each of the pockets 122 and bumper posts 124 can have a structural relationship as to location and dimensions that are in accord with the particular description of a Bumper Pocket Billiards Table as shown by the FIGS. 1 through 10. One pair of similar pockets 122 are positioned on a major axis 126; a second pair of similar pockets 122 are positioned on a first minor axis 128 of BPB Table 118; and, the remaining pair of similar pockets 122 are positioned on a second minor axis 130; all as shown by FIG. 13. Both minor axes 128 and 130 are oriented perpendicular to the major axis 126. Minor axis 128 passes through a first focus 132, and minor axis 130 passes through a second focus 134.

In FIG. 11, the major axis 96 of BPB Table 92 is considered to be equivalent to the imaginary long string of a BCA regulation pocket billiard table. The major axis 110 of FIG. 12 and the major axis 126 of FIG. 13 are considered to be similar equivalents to this BCA identified long string. The minor axes 108 and 109 of BPB Table 100 in FIG. 12, and the minor axes 128 and 130 of BPB Table 10 in FIG. 13 are each considered equivalent respectively to the imaginary head and foot strings of a BCA regulation pocket billiard table. See *BILLIARDS The Official Rules & Records Book*, Billiard Congress of America, Publisher (1998).

AS WILL BE EVIDENCED from the foregoing description of the preferred embodiment, certain aspects of the Bumper Pocket Billiard Table embodiments of the present invention are not limited to the particular details of construction or of function as described and illustrated. It is contemplated by the inventor that other applications and modifications of the invention will occur to those having skill in the art where the invention can find particular use. However, it is intended that the Claims herein shall cover all such applications and modifications that do not depart from the scope and spirit of the invention as has been described and illustrated.

I claim:

1. In a bumper pocket billiard table 10 wherein a circular tabletop 12 has a circular plane playing surface 18 bounded on its perimeter by a circular rail 20 which supports a resilient cushion 22 that has a cushion ball-impact edge or nose 60 extending radially inwardly toward a center point 26 of the playing surface, and at least one pocket opening 28 defined by a pocket lip edge 64 that has a first portion which is partially bounded by a complementary rail-and-cushion cutout portion with the remaining unbounded portion extending beyond the ball-impact edge into the playing surface toward the center point, the COMBINATION THEREOF WITH THE CIRCULAR TOP of:

a) a bumper post site located on the playing surface at a point adjacent to but spaced apart both from the hip edge of the unbounded pocket opening and from the ball-impact edge by first and second selected dimensions BP and D, respectively, b) said first selected dimension BP is the distance between the closest adjacent point at the lip edge of the unbounded portion of the pocket opening and the point of said bumper post site, c) a bumper post positioned on and fastened to the tabletop at said bumper post site, and d) a resilient ring retained by said bumper post, said ring having a ball-impact outer surface extending outwardly and spaced vertically above the plane playing surface of the tabletop, e) said second selected dimension D is the distance between the closest adjacent points on the cushion ball-impact edge and on the ball-impact outer surface of the resilient ring where D has a dimension value no less than the diameter of a representative ball selected for use in the play of BumperGolf™ Billiards.

2. The bumper pocket billiard table of claim 1 in which a plurality of spaced apart bumper post sites are provided adjacent to but spaced apart from the unbounded pocket lip edge, respective ones of a plurality of bumper posts are positioned on and fastened to the tabletop at associated ones of said plurality of bumper post sites, and said second selected dimension D has a constant off dimension value as measured both between the closest adjacent points on the cushion ball-impact edge and on the ball-impact outer surface of the resilient ring of each bumper post so positioned and fastened, and between the closest adjacent points on the ball-impact outer surface of the respective resilient ring of each associated bumper post.

3. The bumper pocket billiard table of claim 2 in which the pocket opening is circular with one radius extending as an imaginary line from a pocket center beyond the pocket hip edge to the center point of the playing surface.

4. The bumper pocket billiard table of claim 3 in which at least one of said plurality of bumper post sites is located on said imaginary line and spaced apart by said first selected dimension BP from the closest adjacent point on said imaginary line at the pocket lip edge.

5. The bumper pocket billiard table of claim 4 in which a plurality of bumper post sites are spaced apart along said imaginary line to provide a range of values for said first selected dimension BP SO THAT the bumper pocket billiard table is adjustable to and thereby compensates for differing levels of playing skills.

6. The bumper pocket billiard table of claim 1 in which said first selected dimension BP has a range of values with a minimum value of about 1.22 inches and a maximum value of about 4.50 inches.

7. The bumper pocket billiard table of claim 1 in which selected ones of four circular pocket openings are positioned at 0°, 90°, 180° and 270° around the perimeter portion of said circular playing surface.

8. The bumper pocket billiard table of claim 7 in which a respective one of a plurality of said bumper posts is positioned on said playing surface along said imaginary line of an associated one of said pocket openings.

9. The bumper pocket billiard table of claim 1 in which said second selected dimension D has a dimension value of no less than 2.25 inches as determined by the diameter of a standard Billiard Congress of America billiard ball.

10. The bumper pocket billiard table of claim 9 in which said second selected dimension D has a range of values with a minimum value of about 2.25 inches and a maximum value of about 5.75 inches.

11. A method to position a bumper post at a selected bumper post site for a bumper pocket billiard table where the table consists of a tabletop that has a plane playing surface bounded on its perimeter by a rail which supports a resilient cushion that has a cushion ball-impact edge or nose extending inwardly above the playing surface, at least one pocket opening defined by a pocket hip edge that has a first portion which is partially bounded by a complementary rail-and-cushion cutout portion with the remaining unbounded portion extending beyond the ball-impact edge into the playing surface toward the center point, and at least one bumper post positioned on and fastened to the tabletop where the bumper post has a resilient ring with the ring having a ball-impact outer surface extending outwardly and spaced vertically above the plane playing surface of the tabletop, the METHOD COMPRISING THE STEPS of:

a) determining a first selected dimension D as measured between the closest adjacent points on the cushion ball-impact edge and on the ball-impact outer surface of the resilient ring such that said dimension D has a value that is no less than the diameter of a representative ball selected for use in the play of BumperGolf™ Billiards, and b) determining a second selected dimension BP as measured from the closest adjacent point at the hip edge of the unbounded portion of the pocket opening to the point of a selected bumper post site where the value of said dimension BP will satisfy said first dimension D when the bumper post is positioned and fastened to the tabletop at the selected bumper post site.

12. The method of claim 11 in which the step of determining said first selected dimension BP develops a range of values with a minimum value of about 1.22 inches and a maximum value of about 4.50 inches.

13. The method of claim 11 in which the step of determining said second selected dimension D develops a range of values with a minimum value of about 2.25 inches and a maximum value of about 5.75 inches.

14. The method of claim 11 in which the step of determining said second selected dimension D develops a range of values with a minimum value of about 2.25 inches and a maximum value of about 6.40 inches.

* * * * *